United States Patent [19]

Johanson et al.

[11] 4,211,385

[45] Jul. 8, 1980

[54] CONCRETE FORM STRUCTURE

[75] Inventors: Ronald C. Johanson, Vancouver, Wash.; Bill W. McDonald, Lake Oswego, Oreg.

[73] Assignee: Foam-Ply, Inc., Portland, Oreg.

[21] Appl. No.: 961,122

[22] Filed: Nov. 16, 1978

[51] Int. Cl.[2] ..... E04G 11/08

[52] U.S. Cl. ..... 249/192; 249/38; 249/43; 249/44; 249/45

[58] Field of Search ..... 249/38, 40, 33, 36, 249/42, 43, 44, 45, 46, 47, 216, 217, 85, 192

[56] References Cited

U.S. PATENT DOCUMENTS

| | | | |
|---|---|---|---|
| 2,014,080 | 9/1935 | Colt | 249/217 |
| 2,526,529 | 10/1950 | Arrighini et al. | 249/38 |
| 3,123,887 | 3/1964 | Boettner | 249/192 |
| 3,141,224 | 7/1964 | Gates | 249/217 |
| 3,385,555 | 5/1968 | Williams | 249/192 |
| 3,438,161 | 4/1969 | Koch | 249/40 |
| 3,687,411 | 8/1972 | Frazier | 249/192 |
| 3,767,158 | 10/1973 | Mikus | 249/192 |
| 4,030,694 | 6/1977 | Schimmel | 249/192 |

*Primary Examiner*—Donald J. Arnold

*Attorney, Agent, or Firm*—Klarquist, Sparkman, Campbell, Leigh, Hall & Whinston

[57] ABSTRACT

The specification discloses concrete forms each including a plurality of rectangular panels secured edgewise together by connectors. Each connector includes a pair of half sleeves secured in a pair of grooves in the edges of the panels, and a cupped head of a connector sleeve wedges the half sleeves together to hold the panels in edgewise abutment. A nut screwed on the connector sleeve draws the cupped head into wedging engagement with the half sleeves. Tie rods extend through the connector sleeves. The panels include wood framing having plywood faces and filled with foamed plastic.

14 Claims, 6 Drawing Figures

CONCRETE FORM STRUCTURE

DESCRIPTION

This invention relates to an improved concrete form structure, and has for an object thereof the provision of a new and improved concrete form structure.

Another object of the invention is to provide a connector having a wedging head which draws together two anchor members secured to adjacent edges of panels to be secured in edgewise abutment.

A further object of the invention is to provide concrete form panels which are easily assembled into a form.

Another object of the invention is to provide an improved concrete form structure wherein a connector sleeve through which a tie rod extends has a cupped head drawn by a nut over ends of half sleeves anchored in grooves in abutting edges of panels to lock the panels together.

Another object of the invention is to provide an improved concrete form panel having a wood frame, plywood sheets forming the faces of the panel, a plastic foam filling the space between the sheets, and a rubber or plastic sealing strip adhered to the edges of the panel.

Figure 1:
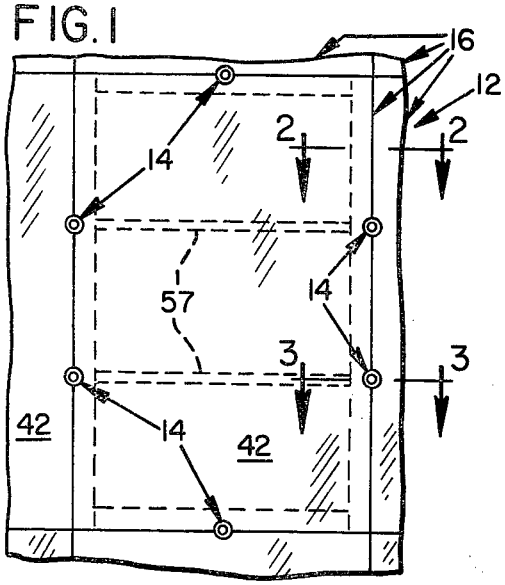
FIG. 1 is a fragmentary, side elevation view of an improved concrete form structure forming one embodiment of the invention.
Figure 3:
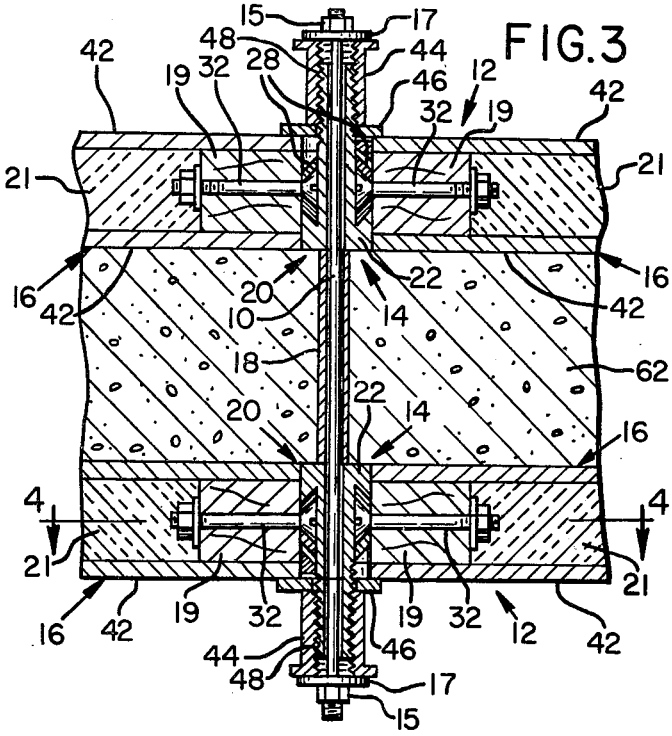
FIG. 3 is an enlarged, horizontal, sectional view taken along line 3—3 of FIG. 1.
Figure 2:
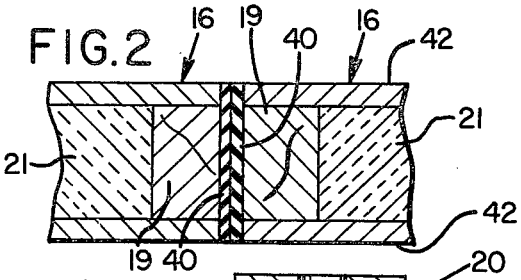
FIG. 2 is an enlarged, horizontal, sectional view taken along line 2—2 of FIG. 1.
Figure 5:
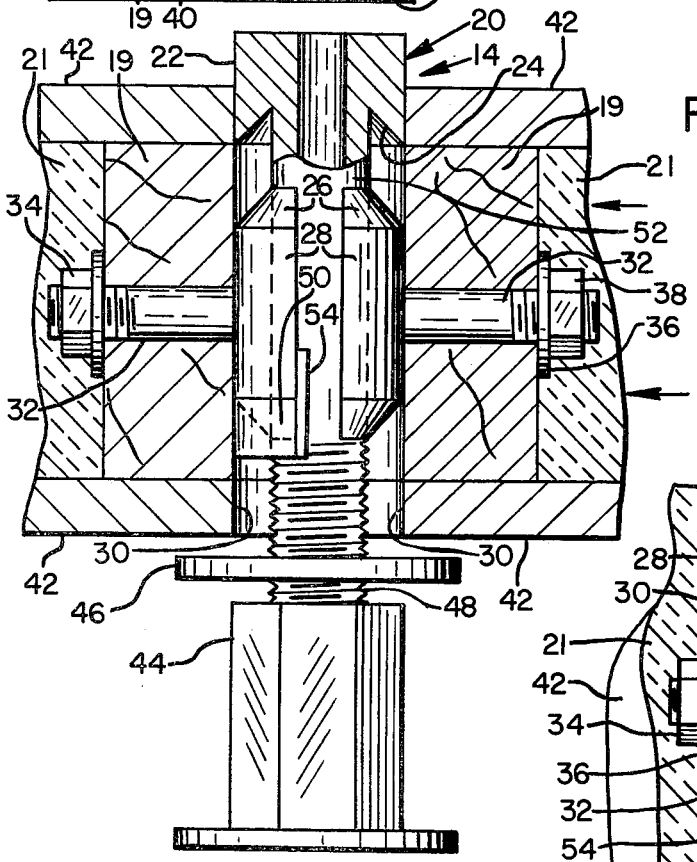
FIG. 5 is an enlarged, horizontal, sectional view similar to FIG. 3 during assembly of a form of the structure of FIG. 1.
Figure 4:
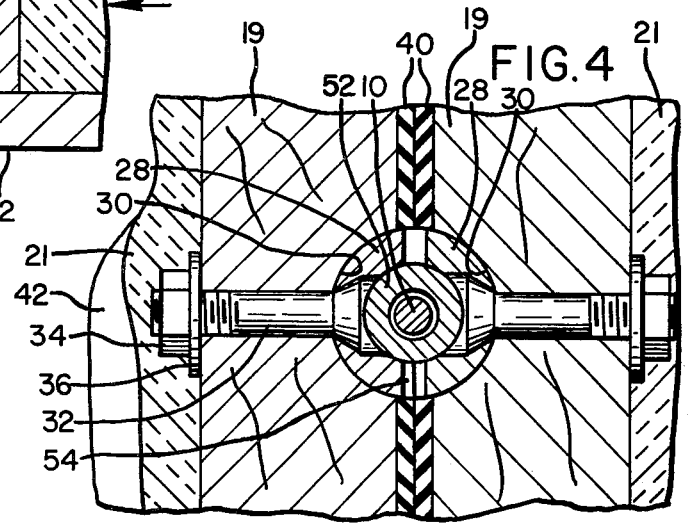
FIG. 4 is an enlarged, vertical, sectional view taken along line 4—4 of FIG. 3.
Figure 6:
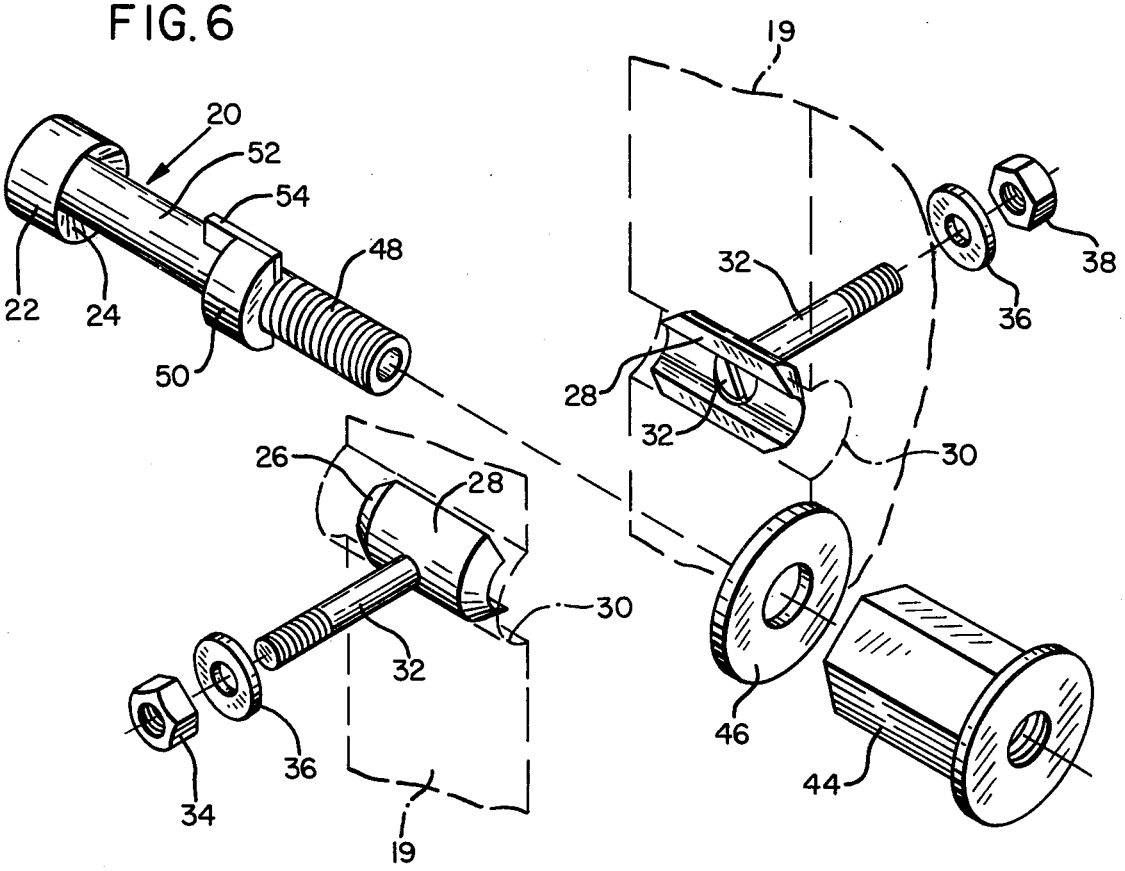
FIG. 6 is an exploded, perspective view of a connector of the structure of FIG. 1.

A concrete rod structure forming a specific embodiment of the invention includes tie rods 10 securing two forms 12 together. The tie rods extend through connectors 14, which connect foam filled panels 16 edgewise together to form the forms 12, and also extend through spacer tubes 18. Nuts 15 and washers 17 are on the tie rods. The panels 16 are nailed to peripheral, wood edge members 19 and foam 21 fills the chambers thus formed. The foam in the panels may be of polystyrene.

Each connector 14 includes a tube 20 having a cupped head 22 having a tapered or wedging inner cup or socket 24, which fits over tapered ends 26 of half sleeves 28 anchored in grooves 30 in wood edge members 19 by flathead screws 32, nuts 34 and washers 36. The washers 36 abut the wood edge members 19. Rubber or plastic sealing strips 40 are placed on all exterior faces of the members 19 and edges of the plywood facing sheets 42. Nuts 44 and washers 46 are screwed onto threaded portions 48 of the tubes 20. The half-sleeves are not quite 180° so as to not engage each other when pressed against the tube 20.

Each tube 20 has a half-sleeve, cupped or tapered retainer (or stop) 50 integral with shank portion 52 thereof and a splining key 54 integral with the retainer 50 and the shank portion. The splining key slides along the half sleeves and keeps the tube 20 from rotating when the nut 44 is screwed onto the tube. The retainer 50 is spaced sufficiently far from the head 22 to permit one of the half sleeves to move therebetween in assembling the panels. Then, the other half sleeve is moved into the head.

Each nut 44 is long enough to pull the head 22 tightly over the tapered ends 26 of the half sleeves 28 with the end of the tube 20 still within the nut 44. The stops 50 keep the tubes 20 from being pushed away by the nuts 44 when the nuts are being started on the tubes.

Flanged nuts 15 are screwed onto the threaded ends of tie rods 10. Concrete 62 is poured into the space between the two forms. Ribs 57 may be secured to the edge members 19. The connectors 14 hold the adjacent panels 16 securely together and with the adjacent faces thereof flush with each other.

What is claimed is:

1. In a concrete form, a plurality of panel members fitting together edgewise, a plurality of arcuate segments secured to the edges of the panel members and forming a sleeve when the panel members are fitted edgewise together, a first fastening member having a shank portion extending through the sleeve and also having an undercut head at one end thereof for overhanging one end of each of the segments, and a second fastener member for drawing the head over the ends of the segments to hold the segments against separation.

2. The concrete form of claim 1 wherein the shank portion is threaded and the second fastening member is a nut engaging the panel members.

3. The concrete form of claim 2 in which the first fastening member is tubular to permit a tie rod to pass therethrough.

4. The concrete form of claim 1 in which each panel member includes a hollow shell filled with a plastic foam.

5. The concrete form of claim 4 wherein each panel has wood edge portions and plywood faces.

6. In a concrete form member, a panel including a wood edge member having a transverse groove, and a half-sleeve arcuate segment secured to the edge member in the groove thereof.

7. In a fastener assembly for a concrete form, a pair of arcuate segments having fastener portions, a fastener member having an undercut head fitting over one end of each of the segments and a shank extending through a hole formed by the segments, and a second fastener member secured to the first fastening member.

8. The fastener assembly of claim 7 wherein the shank is threaded and the second fastener member is a nut screwed onto the shank.

9. The fastener assembly of claim 7 wherein the fastener member has a splining key on the shank.

10. The fastener assembly of claim 8 wherein the shank member has a stop thereon adapted to engage the other end of one of the segments when the nut is being screwed onto the shank.

11. In a fastener assembly for a concrete form, a pair of fastening members adapted to be secured to the edges of two panels of a concrete form, a third fastening member having a head and a threaded shank, and a nut on the shank for pressing against the panels to pull the head into engagement with the pair of fastening members, the head and the pair of fastening members having interlocking portions.

12. The fastener assembly of claim 11 wherein the pair of fastening members have bevelled ends and the head is undercut to receive the bevelled ends.

13. The fastener assembly of claim 12 wherein the third fastening member is tubular.

14. The fastener assembly of claim 13 wherein the pair of fastening members are half sleeves with bolt-like retainers secured to the panels.

* * * * *